US007854196B2

(12) United States Patent
Walz

(10) Patent No.: US 7,854,196 B2
(45) Date of Patent: Dec. 21, 2010

(54) APPARATUS FOR THE COATING OR FLOCKING OF ARTICLES, ESPECIALLY OF TEXTILE MATERIALS AND FLOCKING MACHINE

(75) Inventor: Markus Walz, Lichtenstein (DE)

(73) Assignee: Heinz Walz GmbH, Pfullingen (DE)

( * ) Notice: Subject to any disclaimer, the term of this patent is extended or adjusted under 35 U.S.C. 154(b) by 838 days.

(21) Appl. No.: 11/801,343

(22) Filed: May 9, 2007

(65) Prior Publication Data

US 2007/0272101 A1 Nov. 29, 2007

(30) Foreign Application Priority Data

May 9, 2006 (DE) ..... 10 2006 021 799

(51) Int. Cl.
*B05C 17/04* (2006.01)

(52) U.S. Cl. ..... 101/124; 101/114; 118/406; 118/410

(58) Field of Classification Search ..... 101/114, 101/115, 123, 124, 126, 127.1, 129, 485, 101/486, DIG. 36; 118/213, 406, 410, 421, 118/429

See application file for complete search history.

(56) References Cited

U.S. PATENT DOCUMENTS 3,589,283 A * 6/1971 Childress ..... 101/115
5,185,040 A * 2/1993 Sakai et al. ..... 118/406
5,241,187 A * 8/1993 Ikeda et al. ..... 250/548
5,937,752 A * 8/1999 Uchiyama ..... 101/127.1
6,338,297 B1 * 1/2002 Wang et al. ..... 101/126
6,539,855 B2 * 4/2003 Ball ..... 101/123
6,575,091 B2 * 6/2003 Eppinger ..... 101/126

FOREIGN PATENT DOCUMENTS

DE 196 22 230 A1 12/1997

* cited by examiner

*Primary Examiner*—Ren Yan
(74) *Attorney, Agent, or Firm*—Kriegsman & Kriegsman

(57) ABSTRACT

The invention relates to an apparatus for the coating or flocking of articles, especially of textile material, mats, ceramic, plastic, paper, wood, metal or the like, with a container (12) for receiving a flock or coating material, and with a setting device (16) which is arranged on the container (12) and which has a stencil frame (23) having at least one printing motif (27), the setting device (16) receiving at least one adjusting element (32) which acts in the X- and Y-direction and engages on the stencil frame (23), and the setting device (16) comprising arranged fixing elements (34) which are provided outside the stencil frame (23) at least for arranging an aligning device (38) for the stencil frame (23), in order to align the coating or printing motif (27) of the stencil frame (23) in the X- and Y-direction with respect to the fixing elements (34) by means of the aligning device (38).

17 Claims, 3 Drawing Sheets

APPARATUS FOR THE COATING OR FLOCKING OF ARTICLES, ESPECIALLY OF TEXTILE MATERIALS AND FLOCKING MACHINE

INCORPORATION-BY-REFERENCE OF FOREIGN PRIORITY DOCUMENT

Applicant herein incorporates by reference the following foreign priority document: German Appln. No. 10 2006 021 799.3, filed May 9, 2006.

BACKGROUND OF THE INVENTION

The invention relates to an apparatus for the coating or flocking of articles, especially of textile materials, mats, ceramic, plastic, paper, wood, metal or the like.

In the coating industry, especially the flocking industry, various plants are already in use which make it possible to apply flock material on an article surface wetted with adhesive. The flock material used is preferably short fibres, especially textile fibres. By fibres received in a container being charged electrostatically, the flock material is applied to the article to be flocked.

DE 196 22 230 A1 discloses a flocking apparatus consisting of a plurality of printing units which are assigned in each case to a pallet arranged on a pallet carrier. The pallet carriers are provided on a rotary drive which transports the article arranged on the pallet from processing station to processing station.

Above the pallet is provided a flocking container which in the processing station applies the textile fibres to the article.

These apparatuses have proved appropriate in use. The individual processing stations which are employed in a flocking apparatus may also be provided for manual flocking. In the light of modernization and rationalization, however, it is necessary to develop these apparatuses further.

SUMMARY OF THE INVENTION

The object on which the invention is based, therefore, is to provide an apparatus for the coating or flocking of articles, especially textile materials and flocking machine, which makes it possible to set a printing motif quickly and accurately with respect to the pallet which receives the article to be flocked, and makes it possible to reduce soiling caused by flock material which is not applied.

This object is achieved by means of the features of claim 1. The further advantageous refinements and developments of the invention are specified in the further claims.

By means of the apparatus according to the invention, it becomes possible to set a stencil frame having a printing motif quickly and simply with respect to fixing elements which are assigned to a container receiving the flock material. These fixing elements serve at the same time for receiving and positioning with respect to the stencil frame a pallet which receives the article to be coated or to be flocked, so that an exact positioning of the pallet and therefore of the article to be coated with respect to the aligned stencil frame becomes possible. The stencil frame receives the printing motif via a screen or a fabric. The region to be coated or to be flocked on the article is permeable to the flock material on the fabric or screen, and that region of the article which is not to be coated is designed as a closed surface on the screen or fabric. By means of an aligning device mountable on the fixing elements, the stencil frame can be aligned exactly with respect to the fixing elements in a simple and rapid way. The printing motif is thereby applied with high accuracy to the article to be coated, since the pallet carrying the article to be coated or to be flocked is likewise aligned with respect to the stencil frame by means of the fixing elements. Since the stencil frame is arranged at the upper end of the container and the pallet lies on the stencil frame, flocking from below takes place, that is to say the flock material located inside the container is applied by electrostatic charging from below upwards to the article provided with an adhesive layer. That flock material which does not adhere to the article or lies at least briefly against the impermeable regions of the screen or fabric falls back into the container automatically, so that flocking takes place with extremely low soiling. The arrangement according to the invention thus has the advantage that simple fixing and alignment of the stencil frame are afforded, and also flocking with considerably minimized soiling becomes possible. This apparatus is especially used for coating and flocking of textile material, mats, ceramic, plastic, paper, wood, metal of the like.

According to an advantageous refinement of the invention, there is provision for the setting device for the stencil frame to comprise a bearing surface on which the stencil frame lies at least in portions, and preferably for the fixing elements to be positioned in the bearing surface of the setting device. The stencil frame can thereby be assigned in position to the fixings elements and remains in this position after setting, so that the pallet is laid on the stencil frame in a defined position by means of the fixing elements. The bearing surface of the setting device is preferably fixed to the container. According to a preferred refinement, the bearing surface of the setting device is provided adjacently to the outer wall of the container and so as to surround this.

The fixing elements are preferably designed to be higher than the stencil frame lying on the bearing surface. Both the aligning device and the pallet can therefore lie directly on the stencil frame. When the aligning device is laid in place, an aligning engagement on the stencil frame can take place. When a pallet is laid in place, a sealing-off of the flocking space may be afforded, so that soiling is reduced. The fixing pins constitute the simplest embodiment of fixing elements. It would be appreciated that other elements may be provided for reception with an exact fit and for a quickly releasable arrangement.

The bearing surface of the setting device preferably has adjusting elements which are arranged via mountings on the bearing surface, in order to engage on or in the stencil frame and position the latter with respect to the fixing elements. According to one embodiment, these adjusting elements may be provided as set screws with a thread or fine thread, which are actuated manually. Furthermore, continuously settable positioning elements, for example via clamping, may be provided, in order to make it possible to align the stencil frame in the X- and Y-direction and in an alignment plane. Furthermore, the bearing surface of the setting device preferably receives via mountings adjusting elements which engage on the stencil frame from the alignment of the stencil frame for fixing in the Z-direction.

The aligning device for positioning and adjusting the stencil frame is preferably produced from a transparent material. A simple visual alignment of the stencil frame with respect to the aligning device via indexings or setting markings can thereby take place. The transparent material provided is preferably a plastic, such as, for example, Plexiglas. The aligning device advantageously has a small wall thickness. The wall thickness is designed to be less than 10 mm, especially less than 5 mm, in order to avoid what are known as parallax errors in the alignment of the indexings or setting markings.

The aligning device advantageously has, on one end face, a bore and, on an opposite end face, two U-shaped or V-shaped recesses which are arranged at a distance from one another and are adjacent to the end face and which preferably have an introduction slope. These recesses and bores are adapted in dimensions to the fixing pins arranged on the bearing surface. First, the open-edged recesses of the aligning aid or aligning device are positioned with respect to the fixing elements. Subsequently, the opposite fixing pin is received by the bore. A positioning of the aligning device thus becomes possible simply and quickly. The same applies similarly to a pallet which receives the article to be coated and which preferably comprises the same set-up, especially in a manual flocking station.

The bearing surface of the setting device is provided on an outer container wall and is preferably arranged so as to be sunk with respect to an upper container edge. The stencil frame can thereby surround and cover this free upper container edge. By the stencil frame lying on the bearing surface and/or the screen or fabric of the upper container edge, the inner space of the flocking container is closed off, so that the risk of soiling is reduced. The bearing surface can be set preferably variably in height with respect to the container and, if appropriate, is also exchangeable, so that simple and rapid adaptation to different stencil frames becomes possible.

The aligning device has at least two setting marks which are preferably arranged at a great distance from one another. These setting marks indicate the exact position, on the pallet, of the motif to be flocked. At least two markings are likewise provided on the stencil frame and are at a defined distance from the printing motif, so that the congruent alignment of the markings results in a setting of the stencil frame.

For flocking an article, especially textile material, there is advantageously provision for the article to be flocked to be applied or drawn onto a pallet which is coated with an adhesive in the region of the motif to be applied and which is subsequently positioned with the side to be flocked towards the inside of the container. In a manual flocking station, the pallet is usually designated as a pallet mask which receives the article to be flocked. Mostly, an adhesive layer is previously sprayed on, so that the, for example, textile material lies with a smooth surface on the pallet. By the pallet being aligned via the fixing elements, the region provided with adhesive on the article is arranged congruently with respect to that region of the screen or fabric which is permeable to the flock material.

The apparatus according to the invention for the coating or flocking of articles, especially textile materials, mats, ceramic, plastic, wood, metal, paper or the like, can be used both as a manual station and in an automatic flocking machine which comprises a plurality of printing units. In the individual printing units, flock materials having a different flock length and/or type of flock material and/or colour may be provided. The flocking containers are assigned stationarily to a flocking machine, the pallets being transported intermittently from flocking container to flocking container via a rotary drive. Owing to an upward movement of the flocking container with respect to the pallet or to a downward movement of a pallet with respect to the flocking container or to a relative movement of both, flocking and coating with considerably minimized soiling can become possible. Alternatively to the up-and-down movement of the entire flocking container or of the pallet, it is also possible for only the stencil frame to be moved up and down, a cuff, sleeve or the like of variable length being provided between the stencil frame and the container receiving the flock material, in order to make it possible to have a closed arrangement. The flocking containers may likewise also be provided so as to be movable in relation to the pallets. Such an automatic flocking machine may be designed as a revolving machine or as a longitudinal transfer machine. The number of stations of the flocking machine is determined essentially by the number of printing units.

BRIEF DESCRIPTION OF THE DRAWINGS

The invention and further advantageous embodiments and developments of this are described and explained in more detail below with reference to the examples illustrated in the drawings. The features to be gathered from the description and the drawings may, according to the invention, be employed individually in themselves or severally in any desired combination. In the drawings.

DETAILED DESCRIPTION OF PREFERRED EMBODIMENTS

Figure 1:
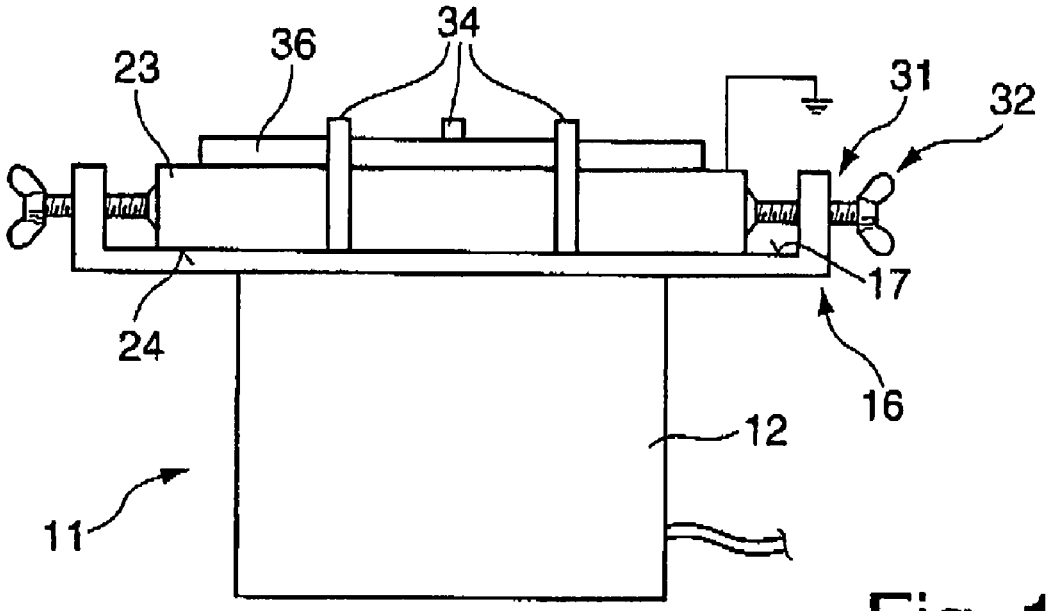
FIG. 1 shows a diagrammatic side view of an apparatus according to the invention for the coating and flocking of articles.
Figure 2:
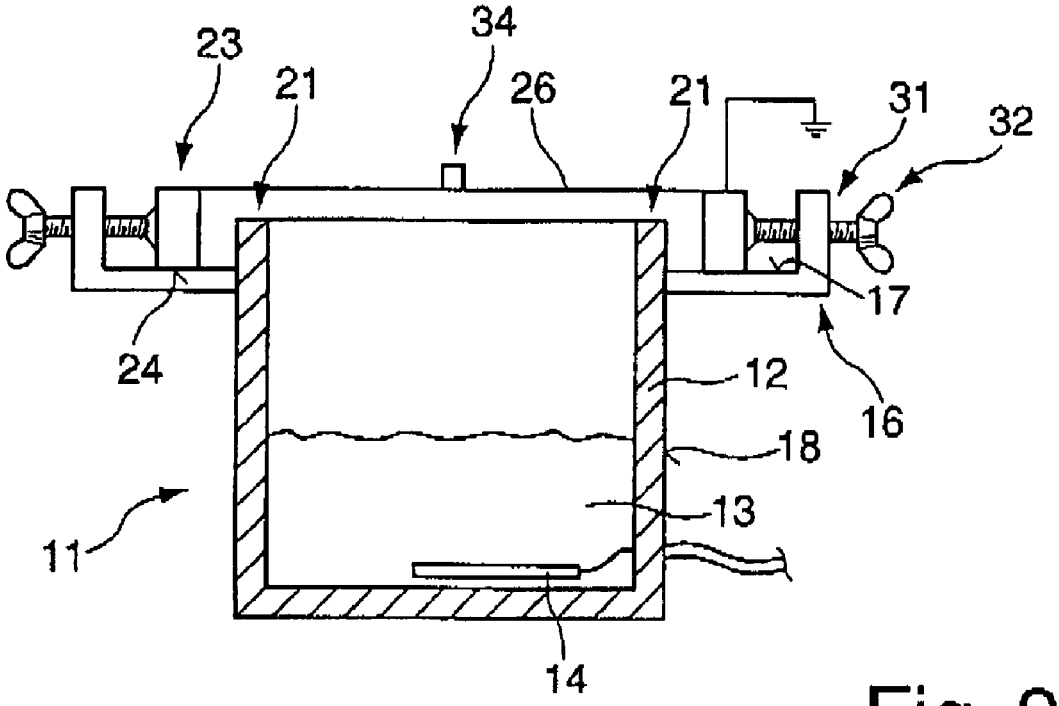
FIG. 2 shows a diagrammatic sectional illustration of the apparatus according to the invention, as shown in FIG. 1.
Figure 3:
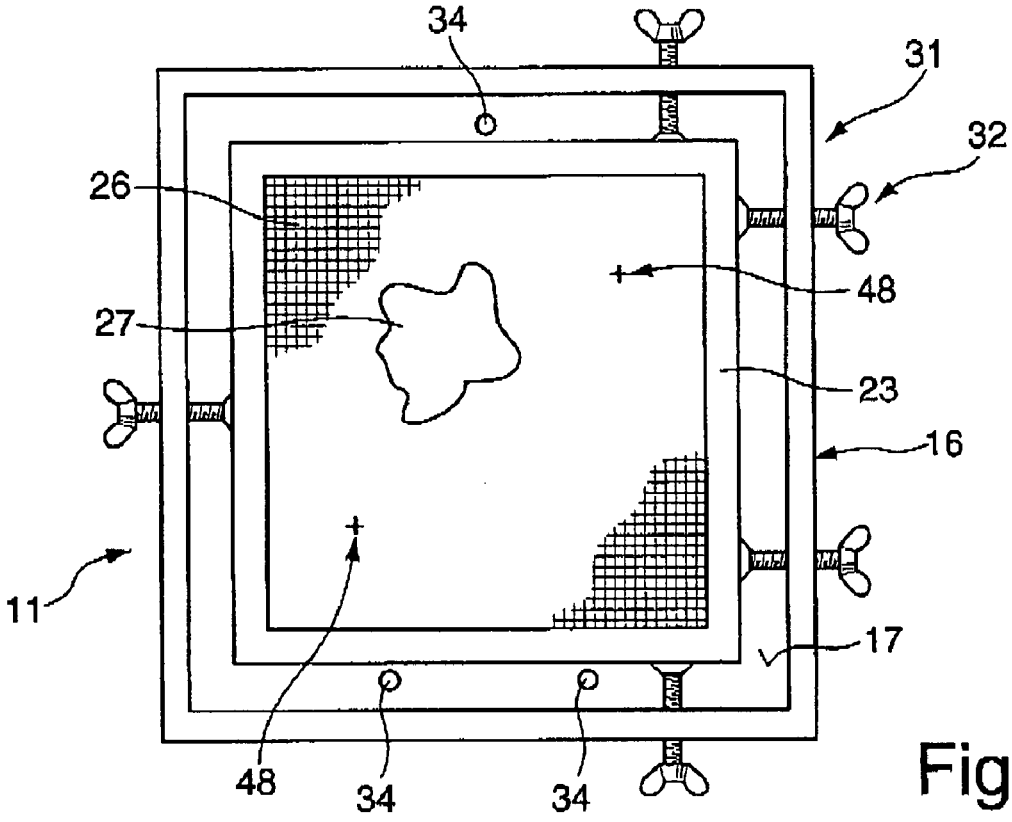
FIG. 3 shows a diagrammatic top view of the apparatus according to the invention, as shown in FIG. 1.

FIG. 1 provides a diagrammatic side view of the apparatus 11 according to the invention for the flocking of an article, especially of a manual flocking station for the flocking of, for example, textile articles. The articles to be flocked may consist of natural or synthetic materials. A finishing of the product takes place as a result of the flocking. The product may, merely by way of example, be articles of clothing or foot mats for inside and outside or for vehicles or decorative articles. FIG. 2 shows a diagrammatic sectional illustration of the apparatus 11 according to FIG. 1, and FIG. 3 illustrates a top view of the apparatus 11 according to the invention, to which reference is made hereafter.

The apparatus 11 comprises a container 12 in which a flock material 13 is provided. In this case, preferably short fibres, especially natural or synthetic textile fibres, are used in order to carry out the flocking. The container 12 comprises, on the bottom, an electrode 14 which is responsible for the electrostatic charging of the fibres. At the upper end of the container 12, a setting device 16 is provided, which, according to the exemplary embodiment, comprises a bearing surface 17 which adjoins the outer walls 18 of the container 12 and is arranged so as to be sunk with respect to an upper container edge 21. Alternatively, there may be provision for the bearing surface 17 to lie against the upper container edge 21 or to form part of the upper container orifice. Furthermore, the setting device 16 may be provided exchangeably with respect to a standard container size 12, so that stencil frames 23 of different size can be used.

The stencil frame 23 illustrated is designed to be larger than the container 12 and surrounds the latter. One end face 24 of the stencil frame 23 lies at least in portions on the bearing surface 17 of the setting device 16. The stencil frame 23 carries a screen or fabric 26 on which a printing motif 27 is applied. This printing motif 27 may be applied by various techniques, those regions of an article which are to be flocked being designed in the motif 27 as permeable regions, and the regions not to be flocked being provided as impermeable regions. The stencil frame 23 is designed, for example, as a rectangular frame by means of tubular profiles, to which the screen or fabric 26 is attached exchangeably. Furthermore, tension elements, not illustrated in any more detail, may be provided on the stencil frame, in order to make it possible to apply a tensioning force to the fabric so as to receive it tautly. The zero potential is connected to the stencil frame 23, so that a directed high-voltage field is applied inside the container to the stencil frame 23 in order to carry out flocking.

The setting device 16 has, on its bearing surface 17, mountings 31 which are designed, for example, as corner angles. These mountings 31 receive adjusting elements 32 in order to align the stencil frame 23 in the X- and Y-direction or in the bearing plane of the bearing surface 17. The adjusting elements 32 comprise, for example, threaded rods which are manually adjustable. Alternatively, sprung pins may also be provided, which can be set continuously by means of a clamping element. In a further embodiment not illustrated in any more detail, there may be provision for the adjusting elements 32 to be driven motively in order to make it possible to align the stencil frame 23. In the top view according to FIG. 4, for example, five adjusting elements 32 are provided. The number and arrangement depend on the configuration of the adjusting elements 32, although at least a number of adjusting elements 32 is provided such that an exact setting and alignment of the stencil frame 23 in the X-/Y-plane become possible.

Figure 4:
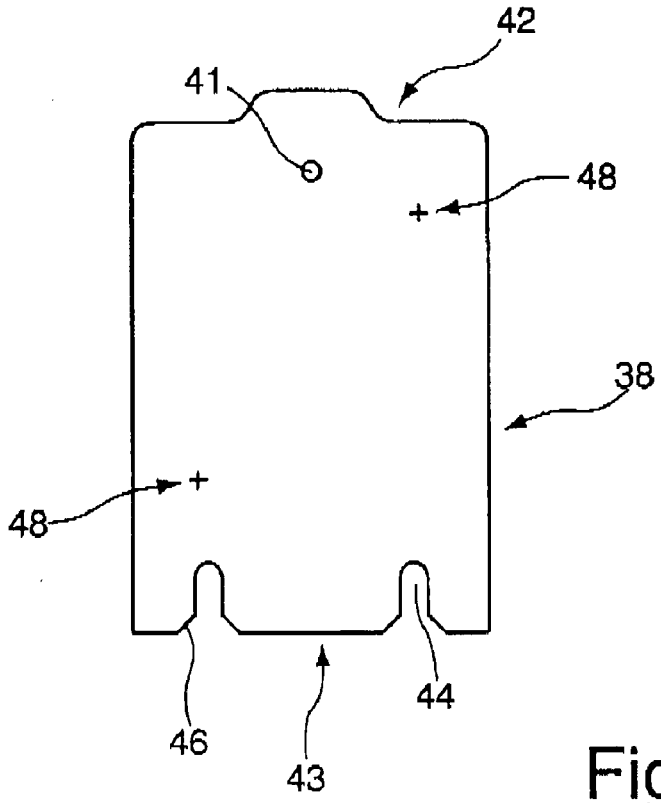
FIG. 4 shows a diagrammatic top view of an aligning device.

The setting device 16 has fixing elements 34, especially fixing pins or fixing bolts, which are arranged firmly in the bearing surface 17. These fixing elements 34 serve for receiving a pallet on which the article to be coated or to be flocked is applied. An aligning device 38 according to FIG. 4 is provided for the simple and rapid alignment of the stencil frame 23 with respect to the fixing elements. This aligning device 38 has, for example, on one end face 42, a bore 41 lying in the plane of symmetry and, on an opposite end face 43, two open-edged U-shaped recesses 44 spaced apart from one another. These recesses 44 may also have V-shaped or other geometries which make it possible to centre the aligning device 38 with respect to the fixing elements 34. In addition, introduction slopes 46 are preferably provided. Such an introduction slope 46 may also be provided on the bore 41 in the form of a countersink.

To set the stencil frame 23 having the printing motif 27 with respect to the fixing elements 34, the aligning device 38 is positioned at the fixing elements 34. At least two setting marks 48 are provided on the aligning device 38. These setting marks 48 are preferably applied on that side which is brought to bear directly with the fabric 26. The aligning device 38, at least in the region of the setting marks 48, is designed to be transparent, preferably is designed to be completely transparent, and has a thin plate thickness, in order to avoid parallax errors in the alignment of the stencil frame 23. Setting marks 48 are likewise provided on the fabric 26 in relation to the printing motif 27. Via the adjusting elements 32 of the setting device 16, the stencil frame 23 is brought into congruence, in respect of its setting marks, with those of the aligning device 38. The aligning device 38 preferably lies directly on the stencil frame 23, in a similar way to the pallet when a flocking or coating operation is carried out. The fixing elements 34 are configured in length in such a way that they project slightly at least with respect to the stencil frame 23 in order to make it possible to align the aligning device 38. Three fixing elements 34 are preferably provided in order to achieve a statically defined reception of the aligning device 38. The arrangement of the fixing elements 34 with respect to one another is merely exemplary, the arrangement of two fixing elements 34 along a side edge of the stencil frame 23 having the advantage that it becomes possible to position the aligning device 38 and the pallet easily via their open-edged U-shaped recesses 44. In the case of a bearing surface 17 which engages on the container edge 21 or extends inside the container 12, there may alternatively be provision for arranging the fixing elements 34 on the container 12. Their length may be variable, according to a further preferred embodiment, in order, for example, to make it possible to set stencil frames 23 of different thicknesses. This variability in the length of the fixing elements 34 may be achieved by exchanging the fixing elements 34 or by adjustability in a similar way to the adjusting elements 32.

By means of the setting device 16, in a preferred embodiment, the stencil frame 23 is fixed at the same time with respect to the bearing surface 17, so that a virtually leaktight closure is afforded. The risk of soiling is thereby minimized considerably.

In a manual flocking station, a pallet 36 has a geometry which corresponds essentially to the aligning device 38 in FIG. 4. It is merely that the setting marks 48 are in this case not required. The article to be coated is laid onto this pallet 36, slipped over or held by means of a releasable adhesive bond, so that it lies on the fabric 26 of the stencil frame 23 during coating or flocking and is aligned with respect to the printing motif 27 of the stencil frame 23 via the bore 41 and recesses 44. To apply flock materials with a different flock length, spacer elements are applied to the fabric 26 adjacently to the motif 27, in order to maintain a defined distance between the fabric 26 and the pallet 36.

Figure 5:
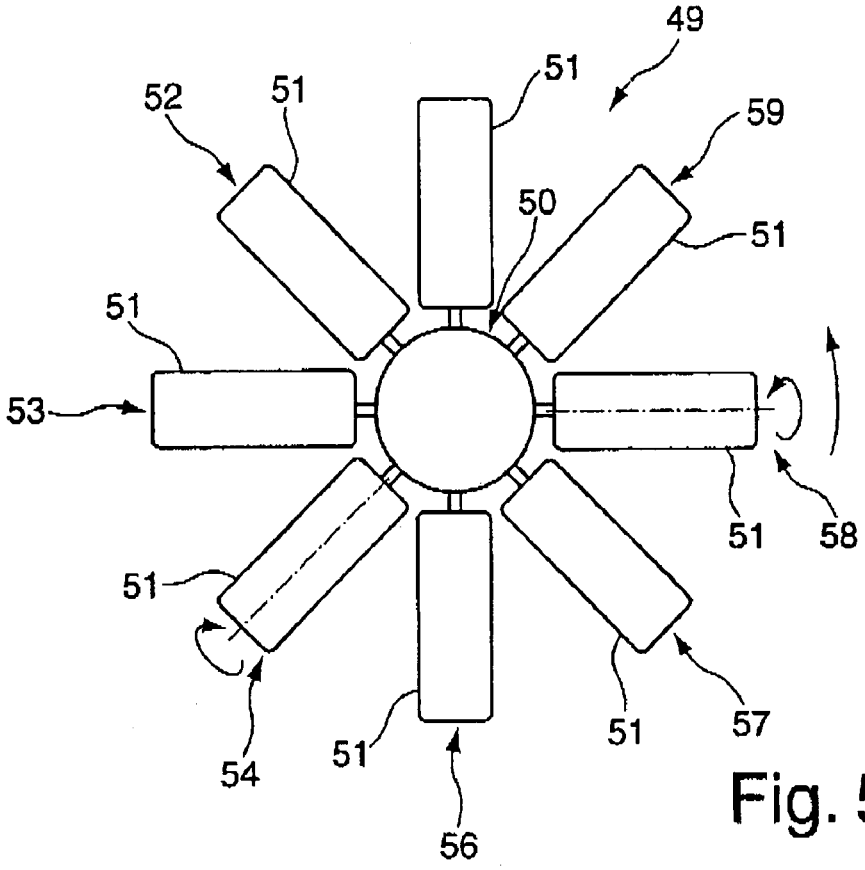
FIG. 5 shows a diagrammatic top view of a flocking machine having a plurality of stations.
Figure 6:
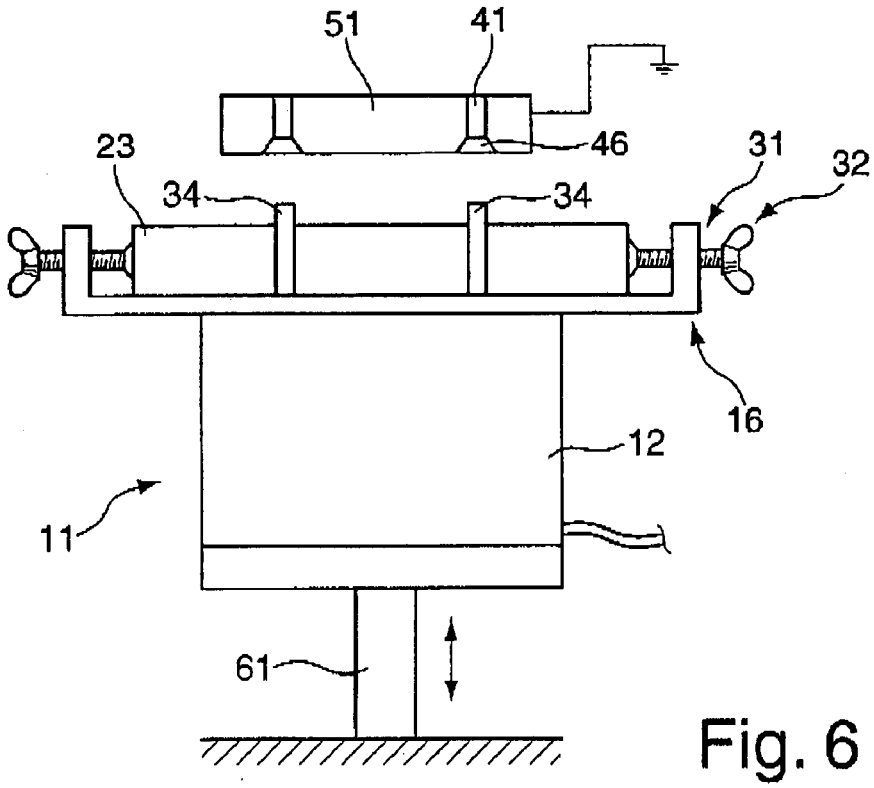
FIG. 6 shows a diagrammatic side view of a coating and/or flocking station according to the invention.

FIGS. 5 and 6 illustrate a flocking machine 49 as a revolving machine which comprises at least one flocking station 56 with the apparatus 11 according to the invention. Such a flocking machine 49 has a basic set-up which corresponds essentially to that according to DE 196 22 230 A1. A plurality of pallets, which are connected to pallet carriers 51 in the flocking machine 49, are transported via a rotary drive 50 from one processing station to the next in order to carry out flocking. In a processing station 52, for example, the surface of a pallet 36 is provided with a spray-on adhesive. In a processing station 53, the article to be coated is applied to the pallet 36. This may be, for example, a textile material. In a processing station 54, the pallet carrier 51 is rotated through 180°, so that the article top side to be flocked points downwards. In a first flocking station 56, which is illustrated in a side view in FIG. 6, flocking with a flock material takes place. In this case, for example, as illustrated in FIG. 6, the apparatus 11 is moved upwards via a lifting cylinder 61, so that the pallet carrier 51 is positioned with respect to the stencil frame 23 via the fixing elements 34 and the pallet comes to bear on the stencil frame 23. Subsequently, by a high-voltage field being applied, flocking is carried out. After the flocking duration provided, the apparatus 11 is lowered via the lifting cylinder 61 and other vertically adjustable mechanisms, and the rotary drive 50 clocks the pallet carrier 51 further on into an empty station or a following flocking station 57. This may comprise flock material which is different in colour, type and/or size of fibres. Subsequently, in a processing station 58, a rotation of the pallet carrier 51 through 180° takes place, so that the article to be coated is prepared for extraction in a processing station 59.

Alternatively to the flocking machine illustrated in FIGS. 5 and 6, a flocking machine may be designed as a longitudinal transfer machine. The stations described in FIG. 5 may be provided one behind the other in one line. Instead of a rotary drive, a linear axis drive is provided which, for example, leads or clocks the pallet carrier successively to the individual processing stations. Alternatively, the pallet carrier may be arranged stationarily, the individual processing stations being moved to and fro beneath the pallet carrier, so the respective processing step is carried out. Furthermore, there may alternatively be provision for providing the pallet carrier on a rotary drive, so that, for example, a series of flocking stations is provided opposite a loading and unloading station, in order to provide the pallet with a spray-on adhesive and with an article to be coated, the pallet subsequently being rotated through 180° horizontally into a processing station. In this processing position, a plurality of flocking stations may be assigned in succession to the pallet carrier. At the same time, a further pallet carrier for a new flocking task may be prepared in the loading and unloading station. The variations and embodiments described with regard to FIGS. 5 and 6 apply similarly to a flocking machine designed as a linear transfer machine. In addition, a drying station may also be provided, especially downstream of the last flocking operation.

The number of pallet carriers 51 in the flocking machine 49 may be selected, as desired. One or more flocking stations 56, 57 may be provided. Furthermore, an adhesive application station and/or an ink application station and/or a printing unit may also be integrated.

According to the above statements, the apparatus 11 according to the invention allows both manual and mechanical use, along with reduced setting times for the stencil frame 23, while at the same time reducing the risk of soiling by the use of flocking from below.

The apparatus 11 according to the invention may also be employed for aligning and adjusting a stencil frame 23 which is provided for applying an adhesive layer to an article in order subsequently to apply the printing motif 27. Furthermore, the apparatus 11 according to the invention may also be provided for use with a liquid or pasty medium requiring an exact alignment of a motif 27.

All the features described above are in each case essential to the invention in themselves and may be combined with one another in any desired way.

What is claimed is:

1. Apparatus for a coating or flocking of articles, with a container for receiving a flock or coating material, and with a setting device which has a stencil frame having at least one printing motif, whereby the container is positioned below the stencil frame and whereby the setting device receives at least one adjusting element which acts in the X- and Y-direction and engages on the stencil frame, and the setting device comprises arranged fixing elements which are provided outside the stencil frame at least for arranging an aligning device for the stencil frame, in order to align a coating or printing motif of the stencil frame in the X- and Y-direction with respect to the fixing elements by means of the aligning device.

2. Apparatus according to claim 1, characterized in that the setting device comprises a bearing surface for receiving the stencil frame.

3. Apparatus according to claim 2, characterized in that the bearing surface of the setting device is arranged on the container so as to be sunk with respect to an upper container edge and is adjacent to the outer wall of the container.

4. Apparatus according to claim 2, characterized the fixing elements are positioned in the bearing surface.

5. Apparatus according to claim 1, characterized in that the fixing elements are designed to be higher than the stencil frame lying on the bearing surface.

6. Apparatus according to claims 1, characterized in that the bearing surface receives via mountings adjusting elements which engage on the stencil frame for the alignment of the latter in the X- and Y-direction.

7. Apparatus according to claim 1, characterized the bearing surface receives via mountings adjusting elements which engage on the stencil frame for the alignment of the latter for fixing in the Z-direction.

8. Apparatus according to claim 1, characterized in that the aligning device is produced from transparent material.

9. Apparatus according to claim 1, characterized in that the aligning device comprises a wall thickness of less than 10 mm.

10. Apparatus according to claim 1, characterized in that the aligning device has, near one end face, a bore and, on an opposite end face, U-shaped or V-shaped recesses which are arranged at a distance from one another.

11. Apparatus according to claim 10, characterized in that the U- or V-shaped recesses are provided with introduction slopes.

12. Apparatus according to claim 1, characterized in that the height of the stencil edge is provided so as to be equal to or greater than a projection of the container edge with respect to the bearing surface of the setting device.

13. Apparatus according to claim 1, characterized in that the aligning device has at least two indexing or setting marks.

14. Apparatus according to claim 1, characterized in that, for coating or flocking an article, a pallet is provided, on which the article is applied or drawn, and the article is positioned with the side to be flocked or to be coated towards the inside of the container and is arranged so as to be aligned with respect to the stencil frame via the fixing elements.

15. Flocking machine having at least one apparatus according to claim 1, characterized in that, for use in a flocking station of the flocking machine, the container is provided on a lifting device movable up and down or a pallet carrier of a flocking machine is provided so as to be movable up and down or the container and the pallet carrier are provided so as to be movable in relation to one another, so that, during each working stroke, the stencil frame is moved into bearing contact on the pallet carrier.

16. Flocking machine according to claim 15, characterized in that the at least one apparatus is provided as a station of a revolving machine having a rotary drive.

17. Flocking machine according to claim 15, characterized in that the at least one apparatus is provided as a station of a longitudinal transfer machine.

* * * * *